US008919999B2

(12) United States Patent
Zimmerman et al.

(10) Patent No.: US 8,919,999 B2
(45) Date of Patent: Dec. 30, 2014

(54) FLAT PANEL LIGHT WITH CLEAR POTTING MATERIAL

(75) Inventors: Joseph J. Zimmerman, Franklin, PA (US); Gregory S. McFarland, Seneca, PA (US)

(73) Assignee: Joy MM Delaware, Inc., Wilmington, DE (US)

( * ) Notice: Subject to any disclaimer, the term of this patent is extended or adjusted under 35 U.S.C. 154(b) by 210 days.

(21) Appl. No.: 13/455,328

(22) Filed: Apr. 25, 2012

(65) Prior Publication Data

US 2012/0275153 A1 Nov. 1, 2012

Related U.S. Application Data

(60) Provisional application No. 61/480,873, filed on Apr. 29, 2011.

(51) Int. Cl.

| | |
|---|---|
| ***F21V 29/00*** | (2006.01) |
| ***F21V 23/00*** | (2006.01) |
| ***F21V 31/04*** | (2006.01) |
| *F21Y 101/02* | (2006.01) |
| *F21W 131/403* | (2006.01) |
| *F21Y 103/00* | (2006.01) |
| *F21Y 105/00* | (2006.01) |

(52) U.S. Cl.

CPC ..... *F21V 31/04* (2013.01); *F21Y 2101/02* (2013.01); *F21W 2131/403* (2013.01); *F21V 23/005* (2013.01); *F21Y 2103/003* (2013.01); *F21Y 2105/001* (2013.01)

USPC . 362/294; 362/218; 362/249.02; 362/311.02; 362/373

(58) Field of Classification Search

USPC ..... 362/249.02, 311.02, 294, 373, 218

See application file for complete search history.

(56) References Cited

U.S. PATENT DOCUMENTS

| | | | | |
|---|---|---|---|---|
| 5,528,474 | A * | 6/1996 | Roney et al. | 362/545 |
| 6,501,084 | B1 * | 12/2002 | Sakai et al. | 250/504 R |
| 7,084,935 | B2 | 8/2006 | Mandler et al. | |
| 7,245,279 | B2 * | 7/2007 | Wang | 345/84 |
| 7,335,921 | B2 | 2/2008 | Magn et al. | |
| 7,607,790 | B2 * | 10/2009 | Chen et al. | 362/97.1 |
| 7,887,218 | B2 * | 2/2011 | Wang | 362/240 |
| 8,136,977 | B2 * | 3/2012 | Chiang et al. | 362/631 |
| 8,292,449 | B2 * | 10/2012 | Poissonnet et al. | 362/101 |

(Continued)

FOREIGN PATENT DOCUMENTS

| | | |
|---|---|---|
| GB | 2486236 A | 6/2012 |
| WO | 2011/120770 | 10/2011 |

OTHER PUBLICATIONS

Loctite Instant Adhesives, Henkel Corporation, 2006, pp. 2-13.

(Continued)

*Primary Examiner* — Robert May

(74) *Attorney, Agent, or Firm* — Michael Best & Friedrich LLP

(57) ABSTRACT

A light for attachment to mining equipment. The light comprises a base, a plurality of PC boards coupled to the base, each of the plurality of PC boards including spaced apart LEDs, a heat sink in thermodynamic communication with the plurality of PC boards, a clear potting material encasing the plurality of PC boards, and a clear cover sealingly attached to the base and overlying the plurality of PC boards, the heat sink, and the potting material.

16 Claims, 5 Drawing Sheets

(56) References Cited

U.S. PATENT DOCUMENTS

| | | | |
|---|---|---|---|
| 2006/0083004 | A1 | 4/2006 | Cok |
| 2006/0239001 | A1 | 10/2006 | Mandler et al. |
| 2009/0272986 | A1 | 11/2009 | Chan et al. |
| 2010/0225220 | A1 | 9/2010 | Tanaka et al. |
| 2010/0244059 | A1 | 9/2010 | Iida et al. |
| 2010/0277914 | A1 | 11/2010 | Bachl et al. |
| 2011/0019416 | A1 | 1/2011 | Poissonnet et al. |

OTHER PUBLICATIONS

Sylgard 184 Silicone Elastomer Product Information, Dow Corning, 2008 (3 pages).
Lexan 103 Resin Datasheet, IDES, Apr. 14, 2005.
Loctite 403 Technical Datasheet, Henkel Corporation, Nov. 2005 (2 pages).
PC 1000 Product Data Sheet, Quadrant Engineering Plastic Products, Jan. 2003 (1 page).
Zelux Product Information, Westlake Plastics Company, 2006 (2 pages).
Durolon Datasheet, Polycarbonatos Do Brasil (1 page).
File History for U.S. Appl. No. 10/434,941 (31 pages).
File History for U.S. Appl. No. 11/454,487 (17 pages).
AU2012202434 Patent Examination Report dated Sep. 17, 2013 (6 pages).
Search Report from the United Kingdom Intellectual Property Office for Application No. 1207347.4 dated Jul. 20, 2012 (3 pages).
Second Examination Report from the Australian Intellectual Property Office for Application No. 2012202434 dated Dec. 9, 2013 (3 pages).

* cited by examiner

FLAT PANEL LIGHT WITH CLEAR POTTING MATERIAL

CROSS REFERENCE TO RELATED APPLICATION

This application claims the benefit of and priority to U.S. Provisional Patent Application No. 61/480,873, filed on Apr. 29, 2011, titled FLAT PANEL LIGHT, the entire contents of which are incorporated herein by reference.

BACKGROUND

Panel lights are widely used in many different industries. For example, in the mining field, and in other fields where operations are performed underground or in dark conditions, it is typical to employ such panel lights to illuminate different work areas. Typically, these panel lights are attached to mining or construction machinery and equipment in order to assist during the day to day operations. Panel lights can be used as area lights, where they light a specific working or digging area, or as head lights, where they are attached to the front of a machine and are used to light the areas ahead of the operating machine.

SUMMARY

In one embodiment, the invention provides a light for attachment to mining equipment. The light includes a base and electronic circuitry coupled to the base. The electronic circuitry includes spaced apart light emitting diodes ("LEDs"). A heat sink is in thermodynamic communication with the electronic circuitry and a clear potting material encases the electronic circuitry. A clear cover is sealingly attached to the base and overlies the electronic circuitry, the heat sink, and the potting material.

In another embodiment, the invention provides a method of making a flat panel light for attachment to mining equipment. The method includes inserting electronic circuitry having a plurality of spaced apart LEDs into a cavity that is defined by a base. A heat sink that defines a plurality of apertures is positioned in thermodynamic communication with the electronic circuitry such that each of the plurality of apertures is substantially aligned with a respective one of the plurality of spaced apart LEDs. The cavity is filled with a clear liquid-like potting material such that the potting material surrounds the electronic circuitry and the heat sink. The potting material is cured such that the potting material transitions from a liquid to a solid. A clear cover is positioned over the cavity such that the clear cover overlies the electronic circuitry, the heat sink, and the potting material. The clear cover is sealingly attached to the base.

In yet another embodiment, the invention provides a flat panel light. The flight panel light includes a clear base formed of plastic. The base includes a bottom, a top, and sidewalls extending between the bottom and the top. The base defines a generally rectangular and upwardly opening cavity that extends between the sidewalls. The light also includes electronic circuitry positioned within the cavity. The electronic circuitry includes spaced apart LEDs. A power cable extends from the housing and is coupled to the electronic circuitry. A heat sink is in thermodynamic communication with the electronic circuitry and includes a top portion defining a plurality of openings that are substantially aligned with the spaced apart LEDs. The heat sink further includes a pair of side portions extending downwardly from the top portion and surrounding the electronic circuitry. A thermal bonding layer is positioned between the heat sink and the electronic circuitry. The thermal bonding layer defines a plurality of openings that are aligned with the plurality of openings of the heat sink and with the spaced apart LEDs. A clear heat conducting and electrically insulating potting material substantially fills the cavity and encases the electronic circuitry, the heat sink, the thermal bonding layer, and a portion of the power cable to at least partially secure the electronic circuitry, the heat sink, the thermal bonding layer, and the portion of the power cable in the cavity. A clear plastic cover overlies the cavity and is sealingly attached to the base by welding.

Other aspects of the invention will become apparent by consideration of the detailed description and accompanying drawings.

DETAILED DESCRIPTION

Figure 1:
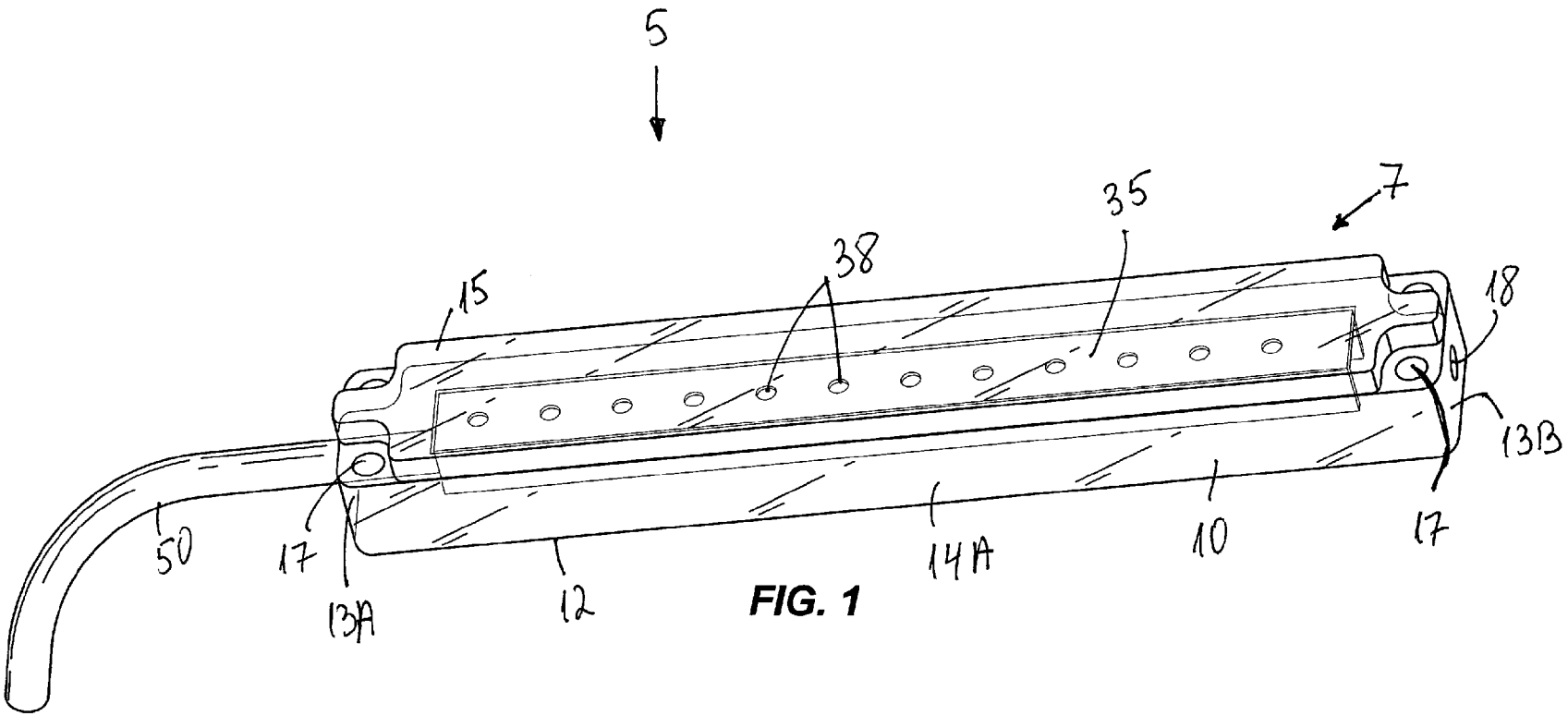
FIG. 1 is a perspective view of a flat panel area light.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limited. The use of "including," "comprising" or "having" and variations thereof herein is meant to encompass the items listed thereafter and equivalents thereof as well as additional items. The terms "mounted," "connected" and "coupled" are used broadly and encompass both direct and indirect mounting, connecting and coupling. Further, "connected" and "coupled" are not restricted to physical or mechanical connections or couplings, and can include electrical connections or couplings, whether direct or indirect. Also, electronic communications and notifications may be performed using any known means including direct connections, wireless connections, etc.

It should be noted that a plurality of hardware based devices, as well as a plurality of different structural components may be utilized to implement the invention. Furthermore, and as described in subsequent paragraphs, the specific configurations illustrated in the drawings are intended to exemplify embodiments of the invention and that other alternative configurations are possible.

Figure 2:
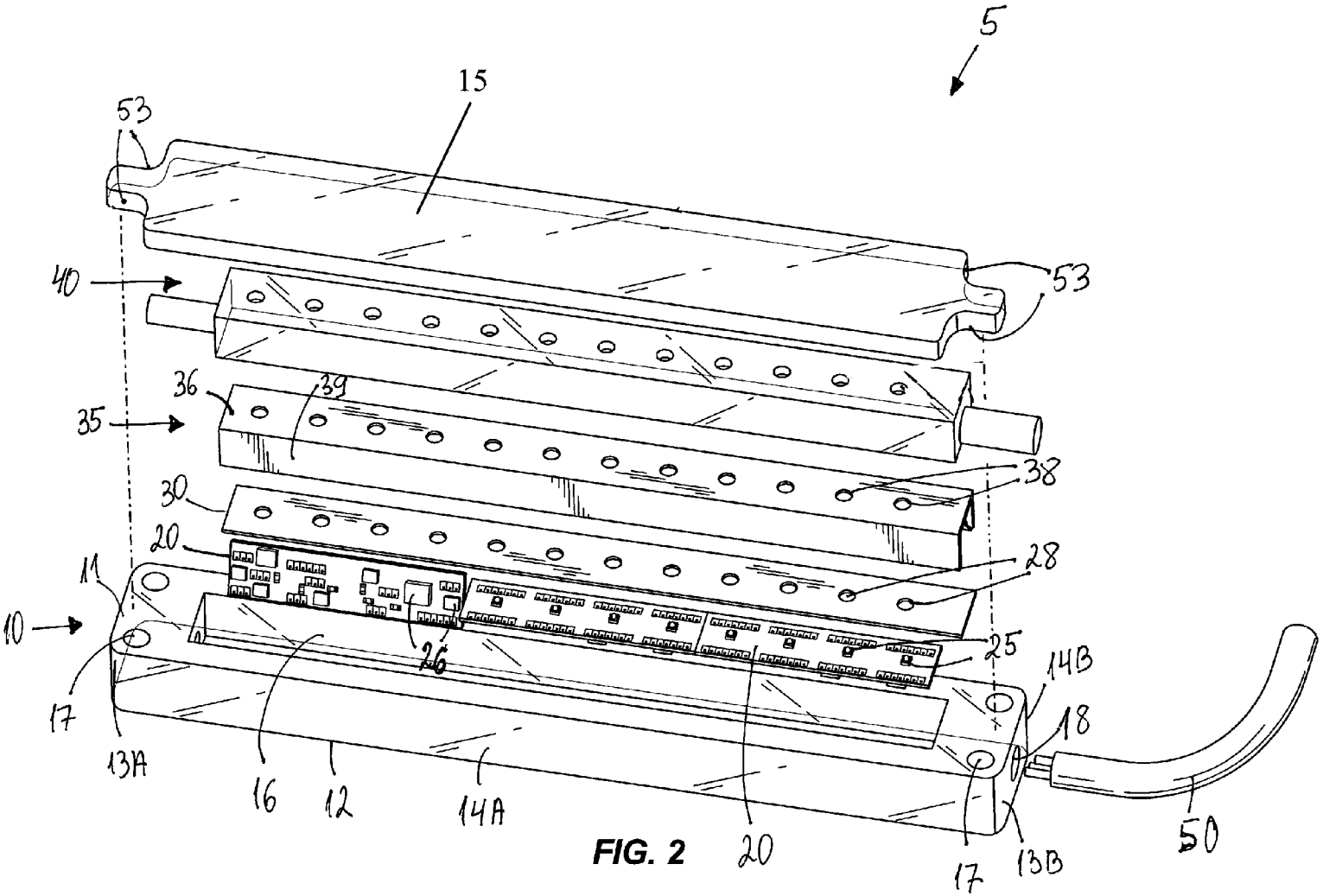
FIG. 2 is an exploded view of the flat panel area light of FIG. 1.

FIGS. 1 and 2 show one construction of a flat panel light 5 configured to be attached to mining machinery or equipment. In particular, the light 5 is a flat panel area light that is used to illuminate a specific working area during the operation of the mining machinery or equipment. The flat panel area light 5 includes a housing 7, having a clear base 10 and a clear cover 15 attached to the base 10. The flat panel area light 5 also includes electronic circuitry that, in the illustrated embodiment, is in the form of a plurality of printed circuit or PC boards 20. Other types of electronic circuitry can also be used.

The electronic circuitry includes a plurality of LEDs 25 and is coupled to the base 10. A thermal bonding layer 30 is in turn attached to the plurality of PC boards 20. The flat panel area light 5 further includes a heat sink 35 that is in thermodynamic communication with the PC boards 20 and the thermal bonding layer 30, a clear potting material 40 that encases the plurality of PC boards 20, and an electrical cable 50 that is connected to the PC boards 20.

In one construction, flat panel light 5 can be used in the mining industry. For example, the flat panel light 5 can be attached to a mining machine (e.g., a shovel, crusher, drill, conveyor, etc.) or other types of mining equipment. In some constructions, the flat panel light 5 can be mounted on a cover or a compartment of the mining machine, under a structure, or on the top of scrubbers or other similar products. Other applications of the flat panel light 5 are also possible.

Figure 3:
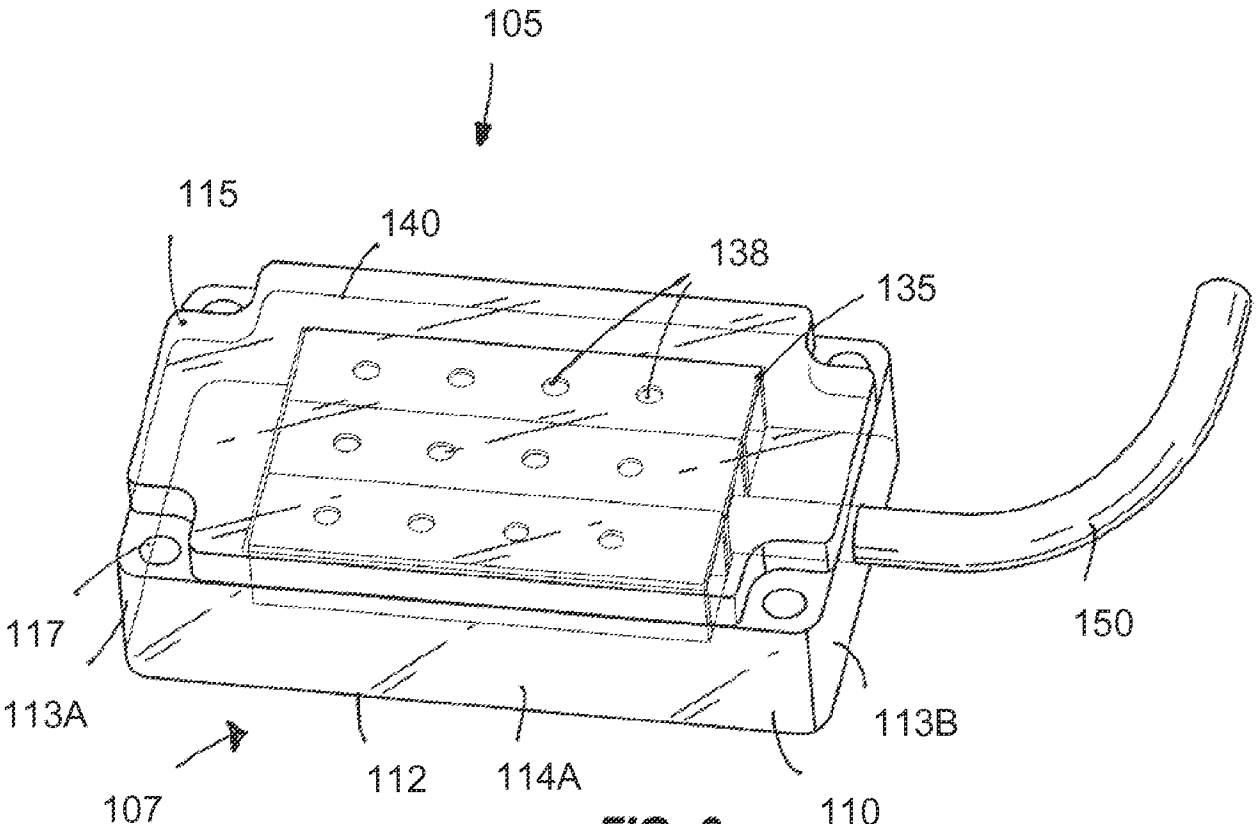
FIG. 3 is a perspective view of another embodiment of a flat panel area light in the form of a headlight.
Figure 4:
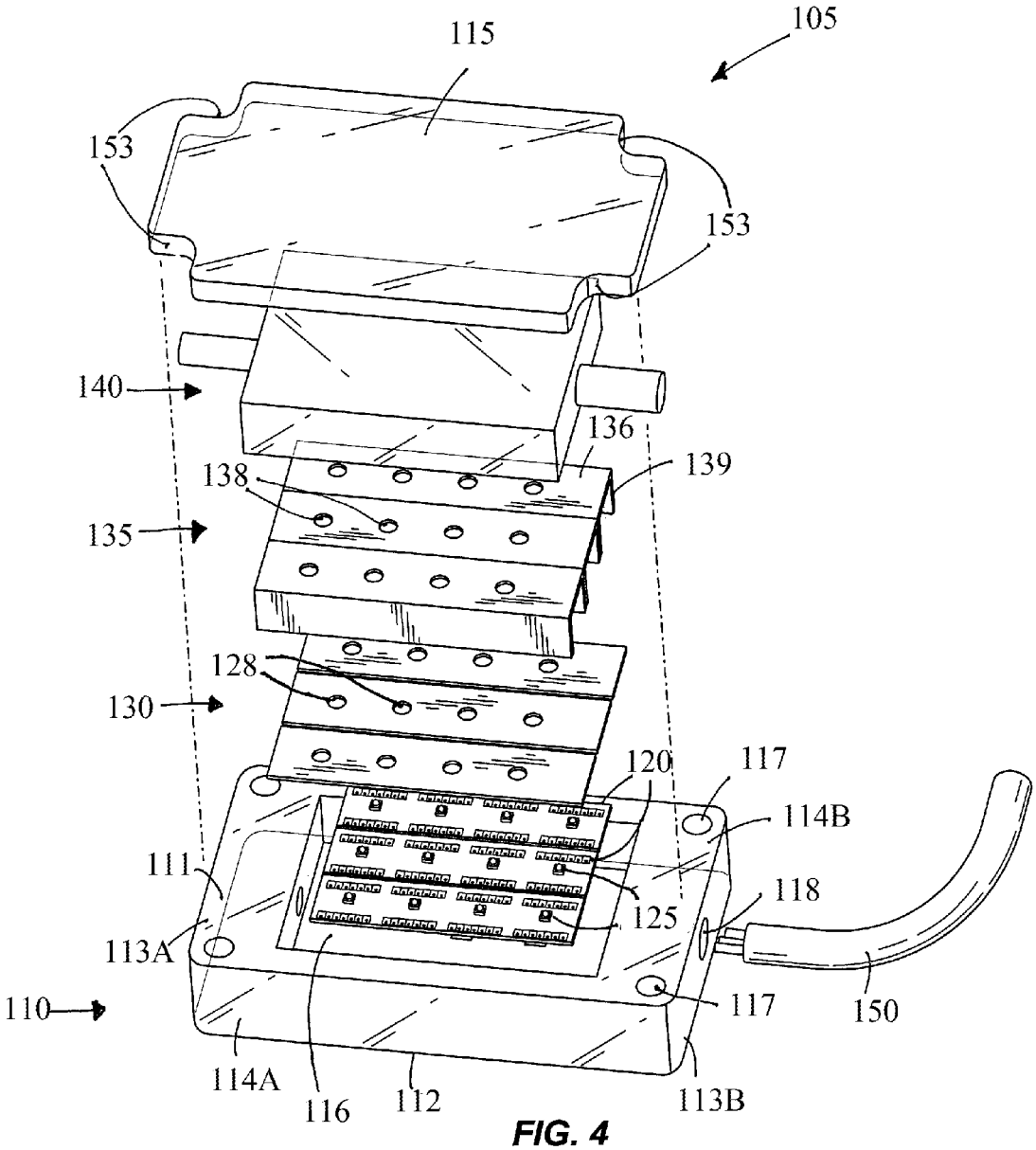
FIG. 4 is an exploded view of the flat panel area light of FIG. 3.
Figure 5:
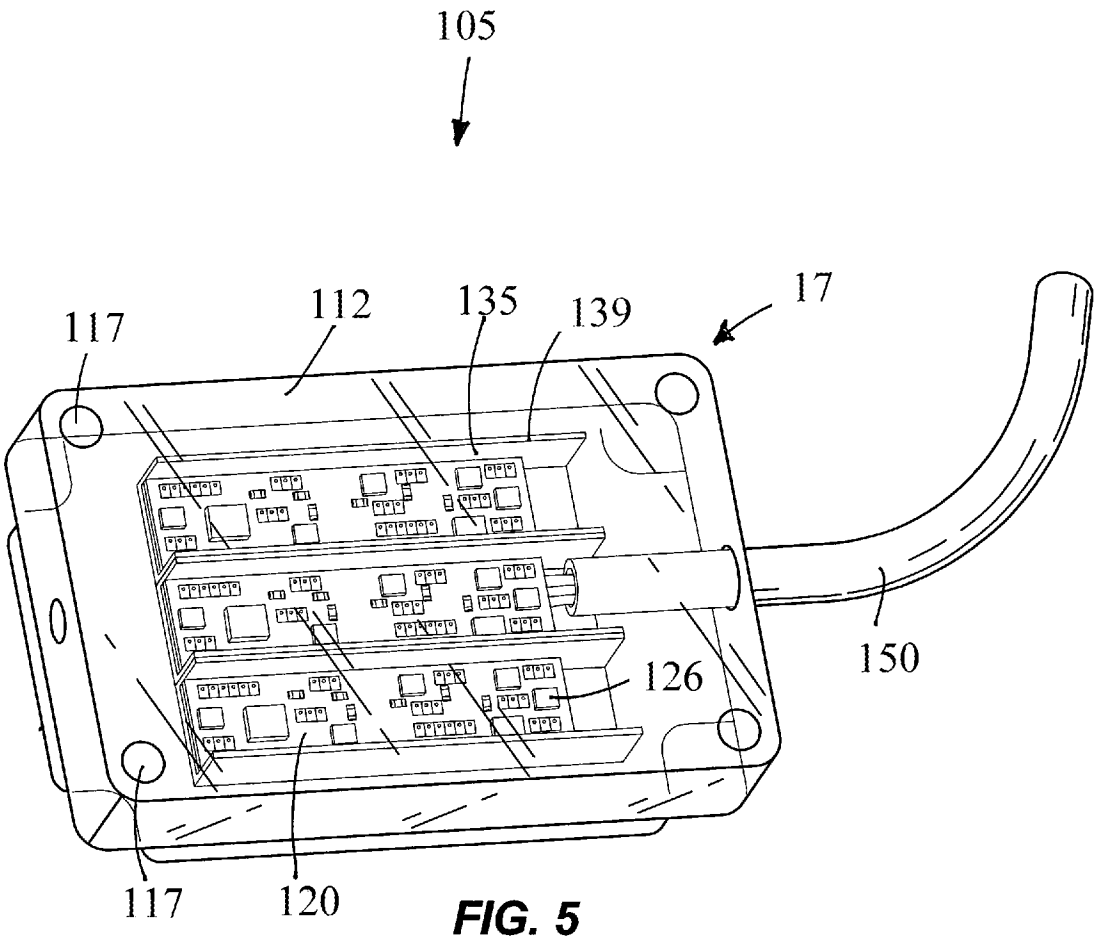
FIG. 5 is a bottom view of the flat panel area light of FIG. 3.

It is to be understood that the flat panel area light 5 illustrated in FIGS. 1 and 2 represents only one exemplary construction of a flat panel light, and thus other constructions are possible. For example, as shown in FIGS. 3-5 alternative constructions can include a flat panel head light that can be attached to various machines and/or structures. Further, the flat panel light 5 can be used in other industries. In one example, the flat panel light 5 can be used in the construction industry and can be placed on machines or vehicles that operate in dusty and/or harsh conditions. The shape, size, and configuration of the flat panel light 5 can be modified for use in other fields.

As shown in FIGS. 1 and 2, the clear base 10 of the flat panel area light 5 has an elongated rectangular cross-section and is configured to accept the plurality of PC boards 20. In alternative constructions, the clear base 10 can have different shapes and forms. In one construction, the base 10 is constructed from one piece of material (e.g., by molding). In other constructions, the base 10 can be constructed from several pieces of material. In the illustrated construction, the base 10 is constructed from a plastic material (e.g., polycarbonate). Other clear plastic materials can also be used to construct the base 10. One of the main features of polycarbonate is that it possesses very high impact resistance. This high impact resistance makes the base of the area light 5 very durable. The size of the clear base 10, and consequently of the panel area light 5, is generally much smaller than the size of the conventional panel lights. In one construction, the panel area light 5 has a length between 9-10 inches, width between 3-4 inches, and height between 1-2 inches. By minimizing the size of the panel area light 5, the panel light 5 becomes less vulnerable to damage during mining and/or construction operations.

The base 10 includes a top portion 11, a bottom portion 12, and two pairs of side portions 13A, 13B and 14A, 14B. The top portion 11 is parallel to the bottom portion 12, and the pairs of side portions 13A, 13B and 14A, 14B are also parallel to each other. In one construction, the top portion 11 defines a cavity 16 that is designed to accept and support the PC boards 20. The PC boards 20 are enclosed in the cavity 16 and are protected by the walls of the base 10. Alternative configurations of the base 10 and the PC boards 20 are also possible.

The top portion 11 also defines a plurality of openings 17 that are used to attach the flat panel area light 5 to a surface. For example, the flat panel area light 5 is attached to a surface of a machine via fasteners (e.g., screws) that pass through the openings 17 and engage the corresponding surface. The bottom portion 12 is generally flat in order to facilitate flush-mount attachment of the flat panel area light 5 to a flat surface. This "flat panel design" enables the area light 5 to be easily mounted to any flat surface of the mining machine. Further, the flat design allows the area light 5 to give extensive illumination to the desired region without creating blinding reflections to workers in the area. In alternative constructions, the bottom portion 12 of the base 10 can have different shapes for attachment to other types of surfaces (e.g., curved surface, etc.).

The side portions 13A and 13B are generally smaller than the top portion 11, the bottom portion 12, and the side portions 14A and 14B. At least one of the side portions 13A and 13B defines at least one opening 18 that accepts the electric cable 50. The electric cable 50 is connected to the PC boards 20 and provides electricity to the boards and, consequently, to the LEDs 25. In alternative constructions, more than one electric cable 50 can be connected to the flat panel area light 5.

As shown in FIG. 2, the plurality of PC boards 20 (e.g., three boards, as illustrated) are coupled to base 10 of the flat panel area light 5. In particular, the three PC boards 20 are positioned end to end and nested into the cavity 16 of the clear base 10. In alternative constructions, the PC boards can be positioned in more than one cavity or directly attached to the top portion 11 of the base 10. The PC boards 20 include a plurality of spaced apart high lumen, low-energy LEDs 25 positioned on the top surface of the PC boards 20. The PC boards 20 also include a plurality of electronic components 26 that control the power transmitted to the LEDs 25. The LEDs 25 are smaller and brighter than the florescent/halogen light bulbs used in conventional flat panel lights. Therefore, the LEDs allow for the construction of a smaller flat panel light that can be also used as a head light (see FIGS. 3-5).

In addition, the flat panel area light 5 is more durable than traditional panel lights because the LEDs 25 are more durable than the florescent/halogen bulbs. Specifically, the LEDs 25 do not have a filament and are less prone to damage resulting from shocks and/or vibrations that are regularly experienced by the panel lights 5. Because of their solid state, the LEDs 25 are much more resistant to jarring, bumping, or heavy vibrations that often occur during the operation of mining and/or construction machinery and equipment. As another advantage, on average, an LED lasts ten times longer than a fluorescent light. These features of the LEDs 25 result in less maintenance of the flat panel area light 5 and less down time for the machine that is using it.

The thermal bonding layer 30 is attached to the plurality of PC boards 20 and used to adhere the PC boards 20 and the heat sink 35. The thermal bonding layer 30 enables the heat emitted by the PC boards 20 and the LEDs 25 to be conducted and transferred towards the heat sink 35. The thermal bonding layer 30 defines a plurality of openings 28 that are substantially aligned with the LEDs 25 so that the light from the LEDs passes through the openings and is directed towards the clear cover 15 of the flat panel area light 5.

In one embodiment, as shown in FIGS. 1 and 2, the heat sink 35 of the flat panel area light 5 completely covers the PC boards 20. In other embodiments, the heat sink 35 can be positioned underneath the PC boards 20. As previously described, the heat sink 35 is adhered to the PC boards 20 by the thermal bonding layer 30. In some constructions, the heat sink 35 is constructed of aluminum and has a high emissivity coefficient (i.e., high relative ability to emit energy by radiation). Therefore, the heat sink 35 draws and dissipates the heat emitted by the PC boards 20 and the LEDs 25 towards the cover 15. The heat sink 35 includes an elongated top portion 36 that is attached to the PC boards 20 via the thermal bonding layer 30, and two elongated side portions 39 that extend downwardly from the top portion 36 and encase the PC boards 20. The top portion 36 of the heat sink 35 defines openings 38 that align with the openings 28 of the thermal bonding layer 30. The side portions 39 of the heat sink 35 fit snugly within the cavity 16 of the base 10 and may therefore be in direct contact with the base 10 to further enhance heat dissipation.

The potting material 40 encases the plurality of PC boards 20 and the heat sink 35. In one construction, the potting material 40 is a clear (i.e., see through) liquid-like material that possesses electrical insulating and heat dissipating characteristics. Thus, the potting material 40 helps to conduct the heat emitted by the PC boards 20 and the LEDs 25 towards the cover 15 and outside the flat panel area light 5. In addition, the potting material 40 enhances mechanical strength, provides electrical insulation, and enhances vibration and shock resistance of the flat panel area light 5. During the construction of the panel light 5, the potting material 40 is introduced into the cavity 16 as aligned and flows to surround the circuit boards 20, thermal bonding layer 30, heat sink 35, and the electrical cable 50 connected to the PC boards 20. The potting material 40 is then cured (e.g., using light or heat) or allowed to cure and solidify. Once the potting material 40 is solidified, the various internal components of the light 5 are effectively secured in place relative to the base 10, thus providing a highly shock-resistant construction.

Flat panel area light 5 is completed by the clear cover 15 that is attached to the base 10. In one construction, the clear cover 15 is sealingly coupled to the clear base 10 by sonic or chemical welding. In other constructions, other methods for joining the cover 15 to the base 10, such as adhesives, can be used.

In one construction, the cover 15 is constructed from plastic material (e.g., polycarbonate). Other clear plastic materials can also be used to construct the cover 15. Because polycarbonate has very high impact resistance, constructing the entire housing 7 of the flat panel area light 5 from polycarbonate increases the durability of the flat panel light 5. This is important for the overall functionality of the flat panel light 5 because, as previously mentioned, the flat panel light 5 is exposed to continuous shocks and/or vibrations during the everyday operation of the mining and/or construction machine. Further, the clear plastic material of the cover 15 allows light from the LEDs 25 to easily illuminate the desired area or object.

In one construction, the corners of the cover 15 define cutouts 53 that create room for inserting screws in the openings 17 of the base 10. The height or thickness of the cover 15 is generally less than the height of the base 10. This construction permits the heat emitted from the PC boards 20 and LEDs 25, and transferred through the thermal bonding layer 30, the heat sink 35, and the potting material 40, to eventually dissipate through the cover 15 (i.e., the heat thermally conducts through the cover 15). In one construction, the cover 15 can include a mark or a logo embedded into the top portion of the cover 15.

To manufacture the flat panel light 5, the PC boards 20 are arranged end to end in the cavity 16 of the base 10. The thermal bonding layer 30 is positioned over the PC boards 20 with the apertures 28 overlying the LEDs 25. The heat sink 35 is then positioned over the PC boards 20 and the thermal bonding layer 30 such that the PC boards 20 are secured to the underside of the top portion 36 of the heat sink 35. The apertures 38 of the heat sink 35 also are aligned with the LEDs 25. The electrical cable 50 is inserted through opening 18 and connected to at least one of the PC boards 20 either before or after the PC boards 20 are secured to the heat sink 35. The cavity 16 is filled with the potting material 40, which starts out in liquid form such that the potting material can flow over and surround the PC boards 20 the heat sink 35, and the thermal bonding layer 30. The potting material 40 is subsequently cured such that the potting material 40 transitions from a liquid to a solid, thus securing the PC boards 20, the heat sink 35, and the thermal bonding layer 30 within the cavity 16. The cover 15 is then positioned over the cavity 16 such that the cover 15 overlies the PC boards 20, the heat sink 35, the thermal bonding layer 40, and the potting material 40. The cover 15 is then sealingly attached to the base 10 by sonic or chemical welding or some other suitable attachment method. The potting material 40 can be cured before or after the cover 15 is attached to the base 10.

FIGS. 3-5 illustrate another construction of a flat panel light 105. The flat panel light 105 of FIGS. 3-5 employs much of the same structure and has similar properties as the previously-described flat panel light shown in FIGS. 1 and 2. Therefore, analogous elements to those of the previous construction have been given the same reference number, increased by one-hundred. One difference between the construction shown in FIG. 3-5 and the previously-described construction is the shape of the housing 107 of the area light 105. Specifically, unlike the housing 7, which is relatively long and skinny, the housing 107 more closely approximates a square. The configuration renders the flat panel light 105 generally better suited for use as, for example, a headlight that can be attached to various underground mining machines. Many of the structural features discussed below are a result of the revised shape of the flat panel light 105.

As best shown in FIGS. 4 and 5, the three PC boards 120 are positioned side by side, with their longer sides positioned adjacent one another for fitment within the cavity 116. The thermal bonding layer 130 and heat sink 135 of the flat panel light 105 are similarly reconfigured to include three shorter portions (relative the thermal bonding layer 30 and heat sink 35) that are arranged side by side to correspond with the arrangement of the PC boards 120. Similar to the heat sink 35, the heat sink 135 includes an elongated top portion 136 and two elongated side portions 139. The potting material 140, which originally is introduced as a liquid, assumes the shape of the cavity 116, and the cover 115 and its cutouts 153 are configured for fitment over the revised housing 107.

Manufacturing of the flat panel light 105 is similar to the above-described manufacturing of the flat panel light 5 but with the PC boards 120, thermal bonding layer 30, and heat sinks 135 being arranged side by side rather than end to end.

Various features of the invention are set forth in the following claims.

What is claimed is:

1. A light for attachment to mining equipment, the light comprising:

a base;

electronic circuitry coupled to the base, the electronic circuitry including spaced apart LEDs;

a heat sink in thermodynamic communication with the electronic circuitry;

a clear potting material encasing the electronic circuitry; and a clear cover sealingly attached to the base and overlying the electronic circuitry, the heat sink, and the potting material, wherein the electronic circuitry and the heat sink are joined via a thermal bonding layer, and wherein the thermal bonding layer and the heat sink are mounted on top of the circuitry and each define a plurality of openings aligned with the LEDs, and wherein light from the LEDs passes through the openings toward the clear cover when the LEDs are turned on.

2. A light as set forth in claim 1, and further comprising an electrical cable connected to the electronic circuitry and having a portion encased in the potting material.

3. A light as set forth in claim 1, wherein the clear cover is sealingly coupled to the base.

4. A light as set forth in claim 3, wherein the cover is sealingly coupled to the base by sonic welding.

5. A light as set forth in claim 1, wherein the electronic circuitry includes a plurality of PC boards.

6. A light as set forth in claim 1, wherein the base is clear and constructed from plastic material.

7. A light as set forth in claim 1, wherein the base defines a cavity, wherein the electronic circuitry, the heat sink, and the potting material are received by the cavity, and wherein the cover overlies the cavity.

8. A light as set forth in claim 1, wherein the heat sink includes a top portion that is attached to the electronic circuitry via a thermal bonding layer, and two elongated side portions that extend downwardly from the top portion and surround the electronic circuitry.

9. A light as set forth in claim 1, wherein the heat sink is constructed of aluminum.

10. A light as set forth in claim 1, wherein the clear cover is constructed from plastic material.

11. A light as set forth in claim 1, wherein the base has a rectangular cross-section.

12. A light as set forth in claim 1, wherein a height of the clear cover is less than a height of the base.

13. A light as set forth in claim 1, wherein the electronic circuitry includes a plurality of elongated PC boards, and wherein the plurality of PC boards are arranged end to end.

14. A light as set forth in claim 1, wherein the electronic circuitry includes a plurality of elongated PC boards, and wherein the plurality of PC boards are arranged side by side.

15. A method of making a flat panel light for attachment to mining equipment, the method comprising:

inserting electronic circuitry having a plurality of spaced apart LEDs into a cavity defined by a base;

positioning a heat sink defining a plurality of apertures in thermodynamic communication with the electronic circuitry such that each of the plurality of apertures is substantially aligned with a respective one of the plurality of spaced apart LEDs;

positioning a thermal bonding layer between the electronic circuitry and the heat sink;

filling the cavity with a clear liquid-like potting material such that the potting material surrounds the electronic circuitry and the heat sink;

curing the potting material such that the potting material transitions from a liquid to a solid;

positioning a clear cover over the cavity such that the clear cover overlies the electronic circuitry, the heat sink, and the potting material; and sealingly attaching the clear cover to the base, wherein the thermal bonding layer includes a plurality of openings, and wherein positioning the thermal bonding layer between the electronic circuitry and the heat sink includes aligning the plurality of openings with the plurality of LEDs.

16. A flat panel light comprising:

a clear base formed of plastic, the base including a bottom, a top, and sidewalls extending between the bottom and the top, the base defining a generally rectangular and upwardly opening cavity extending between the sidewalls;

electronic circuitry positioned within the cavity, the electronic circuitry including spaced apart LEDs;

a power cable extending from the housing and coupled to the electronic circuitry;

a heat sink in thermodynamic communication with the electronic circuitry, the heat sink including a top portion defining a plurality of openings that are substantially aligned with the spaced apart LEDs, the heat sink further including a pair of side portions extending downwardly from the top portion and surrounding the electronic circuitry;

a thermal bonding layer positioned between the heat sink and the electronic circuitry, the thermal bonding layer defining a plurality of openings that are aligned with the plurality of openings of the heat sink and with the spaced apart LEDs;

a clear heat conducting and electrically insulating potting material substantially filling the cavity and encasing the electronic circuitry, the heat sink, the thermal bonding layer, and a portion of the power cable to at least partially secure the electronic circuitry, the heat sink, the thermal bonding layer, and the portion of the power cable in the cavity; and a clear plastic cover overlying the cavity and sealingly attached to the base by welding.

* * * * *